US005077981A

United States Patent [19]

de la Rosa

[11] Patent Number: 5,077,981

[45] Date of Patent: Jan. 7, 1992

[54] METHOD AND APPARATUS FOR ACOUSTIC ATTENUATION IN VARIABLE SPEED COMPRESSORS

[75] Inventor: Richard E. de la Rosa, Warners, N.Y.

[73] Assignee: Carrier Corporation, Syracuse, N.Y.

[21] Appl. No.: 691,923

[22] Filed: Apr. 26, 1991

[51] Int. Cl.[5] ..... C03B 23/04

[52] U.S. Cl. ..... 62/193; 62/196.3; 62/296; 181/403; 417/312

[58] Field of Search ..... 62/296, 196.3, 193; 181/202, 403; 417/42, 312

[56] References Cited

U.S. PATENT DOCUMENTS 3,066,857 12/1962 McCloy ..... 62/296 U X
4,900,234 2/1990 Schrank et al. ..... 62/296 X
4,907,414 3/1990 Fraser, Jr. et al. ..... 62/296 X

*Primary Examiner*—William E. Wayner

[57] ABSTRACT

Radiant sound reduction is achieved in a variable speed compressor by bleeding a small amount of refrigerant into the oil sump for froth production. The refrigerant is bleed from the discharge of the compressor through a solenoid controlled valve which is opened to permit a bleed flow when the compressor is operating at or above a predetermined capacity/speed. This limits system efficiency losses and produces sound reduction only when it is needed.

5 Claims, 1 Drawing Sheet

METHOD AND APPARATUS FOR ACOUSTIC ATTENUATION IN VARIABLE SPEED COMPRESSORS

BACKGROUND OF THE INVENTION

In commonly assigned U.S. Pat. Nos. 4,900,234, 4,907,414 and 5,005,376 a method and structure are disclosed for acoustic attenuation in hermetic compressors. Specifically, reduced radiated sound levels are achieved in low side hermetic compressors which are those in which all or most of the shell is filled with refrigerant at suction pressure. This sound reduction is achieved by diverting a small portion of the compressed refrigerant gas from the muffler and discharging the diverted gas through an orifice into the upper level of the oil in the sump. The method includes the steps of supplying pressurized refrigerant to a muffler, diverting a portion of the pressurized refrigerant supplied to the muffler and injecting the diverted pressurized refrigerant into the oil. This results in a supersaturated solution of refrigerant in oil in the upper level which drives the refrigerant out of the oil, thereby creating froth which provided sound reduction without disturbing the lower level which remains stratified. The fixed, continuous bleed provides sound attenuation without a significant efficiency loss in single speed compressors.

A fixed continuous high to low bleed orifice in a variable speed compressor adversely affects capacity and performance at low speed operation. This is because the leakage is not significantly reduced with a reduction in capacity and therefore the leakage is a higher percentage of the capacity. Additionally, the requirement for sound reduction is capacity related and is therefore normally not needed at low speed operation.

SUMMARY OF THE INVENTION

Variable speed operation of a compressor inherently requires a microprocessor and sophisticated electronics to achieve satisfactory operation. The microprocessor normally has excess capacity which is unused. A solenoid valve is controlled by the microprocessor to activate a bleed orifice at higher operating speeds for acoustic attenuation when it is needed most. Specifically, a solenoid valve is located in a bleed line connected to the discharge of the compressor and terminating in a bleed orifice located beneath the surface of the oil in the sump of the compressor. The solenoid valve seals off the high to low bleed of refrigerant at lower speeds when the acoustic level is lower and the effect of a high to low bleed is most detrimental to capacity and performance. Responsive to the speed reaching a predetermined level, the solenoid valve is opened under the control of the microprocessor thereby permitting a bleed which produces frothing of the oil and thereby sound reduction.

It is an object of this invention to lower the acoustic level of variable speed compressors.

It is another object of this invention to provide a bleed for froth generation only at higher operating speeds.

It is a further object of this invention to eliminate the need for an oil pump stirrer and thereby improve compressor reliability. These objects, and others as will become apparent hereinafter, are accomplished by the present invention.

Basically, a bleeding of discharge gas and its diversion into the oil sump for froth generation is controlled by a solenoid valve responsive to compressor speed.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
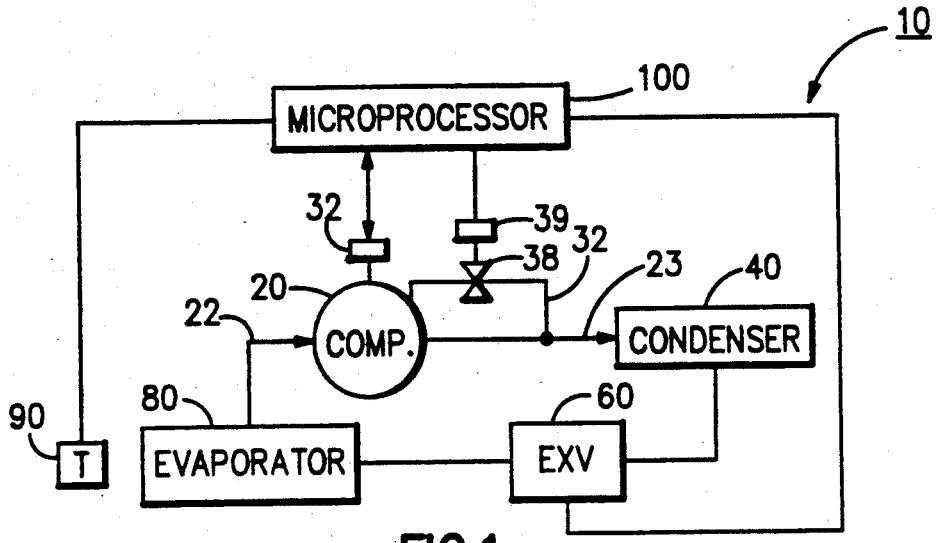
FIG. 1 is a schematic representation of an air conditioning system employing the present invention.

In FIG. 1 the numeral 10 generally designates a refrigeration or air conditioning system which serially includes compressor 20, condenser 40, electronic expansion device or valve (EXV) 60 and evaporator 80, as is conventional. Microprocessor 100 includes a power source and controls compressor 20 responsive to one or more conditions such as the temperature sensed is the conditioned area(s) by one or more thermostats 90, the outdoor temperature, speed of the compressor 20, refrigerant temperature at various locations in system 10, and the power draw for operating compressor 20. Control of compressor 20 is through compressor driver 32. Additionally, microprocessor 100 controls solenoid valve 38 via solenoid 39, and EXV 60.

Figure 2:
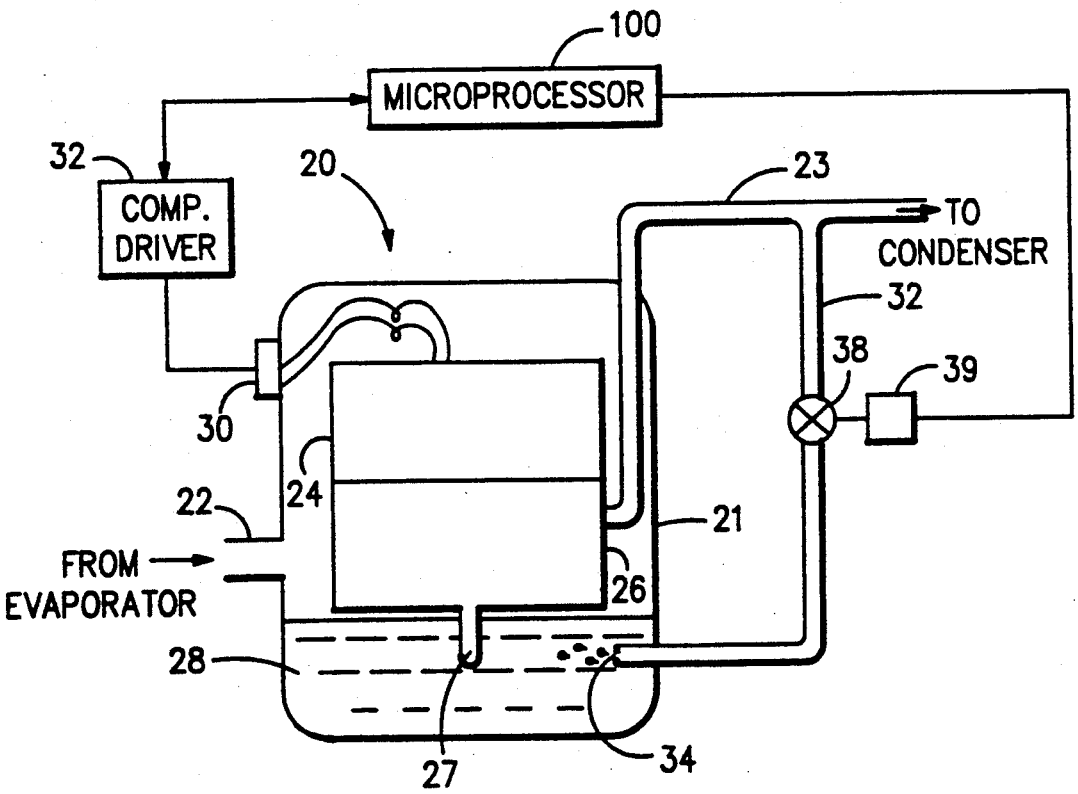
FIG. 2 is a partially schematic representation of the compressed refrigerant injection structure.

Referring specifically to FIG. 2, compressor 20 is a low side compressor and includes a shell 21 and has a suction line 22 connected to evaporator 80 and a discharge line 23 connected to condenser 40. Compressor 20 is illustrated as a reciprocating compressor, but may be a scroll or other rotary compressor. Within shell 21 is a variable speed motor 24 and running gear 26. Running gear 26 does the actual compression of the gas and includes an oil pick up tube 27 extending into oil sump 28. Microprocessor 100 is connected to compressor driver 32 which is connected to variable speed motor 24 through the shell 21 via terminal block 30. Variable speed motor 24 may be an electrically commutated motor (ECM) or may be inverter driven. An ECM is synchronous whereas an inverter driven motor has slippage and runs at, typically, 80–95% of synchronous speed. Compressor driver 32 typically includes an AC to DC bridge (full wave), capacitors, and power switches to synthesize 3-phase power. For residential systems, the input to compressor driver 32 would typically be single phase. Bleed line 32 is connected to discharge line 23 and terminates beneath the surface of oil sump 28. Bleed line 32 contains solenoid valve 38 and includes an orifice 34 which is preferably located at the end of line 32 and has an opening on the order of 0.013 inches in diameter. Although line 32 and valve 38 could be located within shell 21, failure of valve 38, particularly in the open position, could provide performance degradation at low speed as well as difficulty in servicing because of being within the hermetic shell 21.

In operation of the refrigeration or air conditioning system 10, the compressor 20 delivers refrigerant gas at a high temperature and pressure via discharge line 23 to condenser 40 where the refrigerant gives up heat and condenses. The liquid refrigerant passing through EXV 60 is partially flashed and passes into evaporator 20 where the remaining liquid refrigerant takes up heat and evaporates. The gaseous refrigerant returns to compressor 20 via suction line 22 to complete the cycle. Compressor 20, specifically variable speed motor 24, is controlled through compressor driver 32 by the microprocessor 100 responsive to one or more of the conditions noted above in order to match the compressor capacity to the demand. When microprocessor 100 and compressor driver 32 have compressor 20 operating at a predetermined capacity/motor speed, such as midway in the operating range, microprocessor 100 activates solenoid 39 causing normally closed solenoid valve 38 to open. With valve 38 open, a very small portion of the refrigerant in discharge line 23 is diverted through bleed line 32 and orifice 34 into oil sump 28 where it causes froth generation with a resultant reduction in sound generation. Microprocessor 100 will cause valve 38 to be open as long as the compressor 20 is operating at or above the predetermined speed/capacity but will deactivate solenoid 39 and cause valve 38 to close if the compressor 20 is operating below the predetermined speed/capacity.

Control of solenoid valve 38 may also be responsive to other system conditions. For example, a reversible heat pump system has different pressure ratios in heating and cooling. Since higher pressure ratios are noisier, valve 38 may be responsive to the pressure ratio across compressor 20. Also, valve 38 may be a thermal expansion valve (TXV) in some applications.

Although a preferred embodiment of the present invention has been illustrated and described, other modifications will occur to those skilled in the art. For example, the present invention is applicable to all forms of variable speed motors such as ECM motors and inverter driven motors. The term air conditioning, as used above, is intended to cover heating, cooling as well as reversible heat pump operation. It is therefore intended that the present invention is to be limited only by the scope of the appended claims.

What is claimed is:

1. A method for acoustic attenuation of a variable speed compressor having a oil sump and located in an air conditioning system comprising the steps of:

operating a variable speed compressor in an air conditioning system responsive to thermostatic demand in the system;

responsive to an operating parameter of the variable speed compressor reaching a predetermined level, bleeding a portion of the discharge of the compressor into the oil sump of the compressor for froth generation and acoustic attenuation;

continuing to bleed a portion of the discharge of the compressor into the oil sump as long as the operating parameter has reached the predetermined level; and ceasing bleeding a portion of the discharge of the compressor whenever the operating parameter is below the predetermined level.

2. The method of claim 1 wherein the operating parameter is the operating speed of the variable speed compressor.

3. An air conditioning system including a closed loop containing refrigerant and serially including variable speed compressor means, condenser means, expansion means, and evaporator means and being under the operative control of microprocessor means;

said compressor means including a shell, with an oil sump, variable speed motor means and running gear means is said shell and being connected to said condenser means via a discharge line;

bleed line means connected to said discharge line and extending into said oil sump; and valve means in said bleed line means responsive to an operating parameter of said compressor means whereby said valve means opens when said compressor means is operating at a predetermined level of said operating parameter to thereby cause a bleed flow to take place resulting in frothing as refrigerant is discharged into said oil sump which produces a resultant acoustic attenuation.

4. The air conditioning system of claim 3 wherein said operating parameter is compressor operating speed and said microprocessor means controls said valve means responsive to said operating speed.

5. The air conditioning system of claim 3 wherein said compressor means is a low side compressor and said bleed line means includes an orifice.

* * * * *